United States Patent [19]

James

[11] 4,071,418

[45] * Jan. 31, 1978

[54] ELECTRODEPOSITION OF ZINC AND ADDITIVES THEREFOR

[75] Inventor: Barrie Sydney James, Kingswinford, England

[73] Assignee: W. Canning & Company, Ltd., Birmingham, England

[ * ] Notice: The portion of the term of this patent subsequent to Jan. 31, 1995, has been disclaimed.

[21] Appl. No.: 675,480

[22] Filed: Apr. 9, 1976

[30] Foreign Application Priority Data

Apr. 15, 1975 United Kingdom ..... 15482/75

[51] Int. Cl.[2] ..... C25D 3/22

[52] U.S. Cl. ..... 204/55 R; 204/DIG. 2

[58] Field of Search ..... 204/55 R, 55 Y, 43 Z, 204/44, DIG. 2, 114

[56] References Cited

U.S. PATENT DOCUMENTS

| | | | |
|---|---|---|---|
| 1,564,414 | 12/1925 | Hoff | 204/50 Y |
| 3,886,054 | 5/1975 | Duchene et al. | 204/55 R |

FOREIGN PATENT DOCUMENTS

| | | | |
|---|---|---|---|
| 1,295,067 | 11/1972 | United Kingdom | 204/55 Y |

*Primary Examiner*—G. L. Kaplan

*Attorney, Agent, or Firm*—Marn & Jangarathis

[57] ABSTRACT

Bright zinc plate is obtained from alkaline, cyanide-free zinc plating baths containing (a) at least one linear polyamine obtained by condensing an aliphatic diamine containing at least one tertiary amino group with a 1,3-dihalopropan-2-ol, and (b) at least one substituted pyridine compound in the form of a free base or as a quaternized derivative. A brightener composition containing the linear polyamine and the pyridine compound can be added to alkaline, cyanide-free zinc plating baths.

17 Claims, No Drawings

ELECTRODEPOSITION OF ZINC AND ADDITIVES THEREFOR

This invention relates to the electrodeposition of zinc from an alkaline bath and more particularly to the addition of specific combinations of compounds, which are prepared as described below, to such baths to produce bright deposits.

At present the major proportion of commercially fabricated components are coated with zinc electrodeposits plated from alkaline solutions containing a soluble zinc salt, hydroxide ion and quantities of cyanide. The use of such cyanide-containing baths poses considerable problems in operation from the very poisonous nature of cyanide and also from the disposal of wastes, like spent solutions and other discharged effluent from running-water rinsing tanks. Since the limits on the quantities of cyanide that may be discharged are being reduced, effluent treatment is becoming increasingly more difficult and consequently more expensive. As the maximum tolerances imposed by various Government Authorities become lower, their achievement necessitates the installation of expensive effluent treatment plants and closer control of all cyanide-containing materials, including spent or waste solutions.

It is with these problems in mind that more attention is being given to non-cyanide plating processes. These may be divided into three main classes — acid, neutral and alkaline. All three have their individual characteristics, although the neutral process, which works in the pH range 6 - 8, is really only an extension of the acid zinc plating process based on solutions which operate in the pH range of 3 - 6. The neutral and acid processes are frequently based on $NH_4Cl$ or $NH_4SO_4$, with the ammonium ion playing the same complexant role as cyanide does in the normal commercial cyanide plating processes.

Alkaline non-cyanide baths operate in the pH range 8 - 14, usually between pH 10 - 12, and are based on a solution of sodium zincate with excess hydroxide ions. This type of bath without any addition agent yields a dull, spongey electrodeposit of poor appearance. There thus exists a need for addition agents to prevent electrodeposits of this type and to give instead a bright and uniform mirror-like electrodeposit of pleasing appearance.

A problem often associated with the conventional cyanide-free alkaline zinc solutions now commercially available is that they do, in fact, require addition of small amounts of cyanide ions in order to produce a deposit of acceptable brightness. Alternatively, a conventional type of complexing agent, such as sodium gluconate, is added which usually creates more effluent problems than it solves. Conventional complexing agents pose the problem that they render it difficult to remove zinc from the effluent water and should this effluent be mixed with that from other processes, such as those from nickel or copper plating, then these metals too are very strongly complexed and difficult to remove from solution by the conventional purification techniques. This means even more expensive effluent purification techniques are necessary.

The present invention provides the use of a polyamine addition agent in combination with a pyridine compound having a synergistic effect, in cyanide-free alkaline zinc plating solutions to aid the production of bright uniform zinc electrodepositions.

According to the present invention we provide an alkaline, cyanide-free zinc plating bath containing zinc ions and hydroxyl ions and a. at least one linear polyamine obtained by condensing a diamine of the formula:

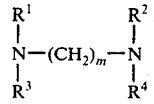

(I)

where $R^1$ and $R^3$, which may be the same or different, each represent an alkyl group with 1 to 4 carbon atoms, and $R^2$ and $R^4$, which may be the same or different, each represent a hydrogen atom or an alkyl group with 1 to 4 carbon atoms, and where *m* is an integer from 1 to 5, with a 1,3-dihalopropan-2-ol; and b. at least one pyridine compound substituted with a cyano, carboxy (free or as a salt), esterified carboxy, carbamoyl or substituted carbamoyl group, in the form of a free base or as a quaternised derivative. The pyridine compounds may be in the form of free bases or quaternised with a conventional quaternising agent.

The pyridine compound is advantageously of the general formula:

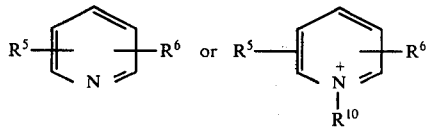

(IIa) (IIb)

where $R^5$ represents a hydrogen atom or an alkyl group with 1 to 5 carbon atoms; and $R^6$ represents a cyano group, a group —$COOR^7$ where $R^7$ represents a hydrogen atom, an alkali metal cation or an alkyl group with 1 to 5 carbon atoms; or a group —$CONR^8R^9$ where $R^8$ and $R^9$ which may be the same or different each represents a hydrogen atom or an alkyl group with 1 to 5 carbon atoms; and $R^{10}$ represents an aralkyl, alkyl, alkenyl, esterified carboxyalkyl or hydroxyalkyl group. $R^6$ is preferably in the 3-position.

The quaternising agent is preferably an aralkyl or alkenyl halide such as benzyl chloride or allyl bromide or a halo-ester such as ethyl chloroacetate.

Table I illustrates examples of the substituted pyridine compounds and Table II some of the quaternising agents. These Tables are not intended to be exclusive and only illustrate the types of organic chemicals which may be used in this invention.

TABLE I

| Substituted Pyridines of Formula II |
|---|
| Nicotinic acid |
| Nicotinamide |
| N,N-Diethyl-nicotinamide |
| 3- Cyanopyridine |
| 4- Cyanopyridine |
| Methyl nicotinate |
| Ethyl nicotinate |
| Isonicotinic acid |
| 2- Picolinic acid |
| Butyl nicotinate |

TABLE II

| Quaternizing Agents | Quaternising Group Provided |
|---|---|
| Benzyl chloride | Benzyl |
| Ethyl Chloroacetate | Ethoxycarbonylmethyl |

TABLE II-continued

| Quaternizing Agents | Quaternising Group Provided |
|---|---|
| 1- Bromopropane | Propyl |
| 3 - Bromopropene (allyl bromide) | Allyl |
| Ethyl chloride | Ethyl |
| Ethylene oxide | 2- Hydroxyethyl |
| 3- Ethyl-bromo-propionate | 2- Ethoxycarbonylethyl |
| 2- Chloro-ethanol | 2-Hydroxyethyl |
| Propylene oxide | 2- Hydroxypropyl |

Some of these compounds and their preparation are described in U.S. Pat. Nos. 1,170,058 (E.I. Du Pont de Nemours & Co.) and 1,047,132 (The Udylite Corporation). These patents are concerned with the application of compounds in cyanide plating baths. In non-cyanide baths quaternised pyridine compounds by themselves have very little effect compared with the spectacular changes wrought by them in conventional cyanide baths. Even their combination with colloids found to be beneficial in cyanide baths does little in non-cyanide baths and only results in a dull spongey electrodeposit little better than that obtained from the inorganic solution without any organic addition agents being present.

The quaternised pyridinium compounds are again only effective in combination with the polyamines already mentioned, when brilliant uniform deposits may be achieved by using both the addition agents in the correct combination.

The linear polyamines of this invention may be prepared by refluxing a diamine, examples of which are illustrated in Table III, with the dihalide, e.g. 1,3-dichloropropan-2-ol and 1,3-dibromopropan-2-ol, in a suitable solvent. As solvent water is preferred, but also alcohols, ethers, aromatic hydrocarbons such as benzene, or similar organic solvents may be used. The amount of both reactants may be varied to yield compounds of varied molecular weight.

TABLE III

| Generic Formulae | Examples |
|---|---|
| $R^1R^3N(CH_2)_nNH_2$ | 3-dimethylamino-propylamine |
| | 3-diethylamino-propylamine |
| | 4-diethylamino-butylamine |
| | 2-dimethylamino-ethylamine |
| | 2-diethylamino-ethylamine |
| $R^1R^3N(CH_2)_nNHR^2$ | N,N,N'-trimethyl-ethylene diamine |
| | N,N,N'-triethyl-ethylene diamine |
| $R^1R^3N(CH_2)_nNR^2R^4$ | N,N,N',N'-tetramethyl-1,2-diamino-ethane |

All aspects of the invention apply both to zinc electroplating performed by suspending articles on conducting jigs hung in the solution and also to zinc plating carried out in so-called barrels. Barrel plating, a term well known in the trade, implies a bulk of articles being electroplated either in a hollow plastics or rubber vessel with perforated walls immersed and rotating in the solution or in a hollow plastics or rubber vessel with solid walls revolving at some angle above the horizontal, in both cases electrical contact being made to the bulk of articles by metal conductors inserted through the walls.

The production of different molecular weights of polyamine may be illustrated by considering the following simplification. If two moles of the diamine $(CH_3)_2N\ CH_2CH_2CH_2\ NH_2$ are reacted with one mole of a 1,3-dihalopropan-2-ol, the product expected contains two molecules of the amine joined with a hydroxypropane bridge. If, however, only one mole of each is taken, a higher molecular weight would be expected, the chain length depending on the reaction time and conditions. Thus the nearer the ratio of reactants approaches 1:1 the more higher molecular weight components will be present in the reaction misture. Conveniently, the ratio of diamine to dihalide used may vary from 2:1 to 1:2.

The proportion of polyamine used in the plating bath is desirably in the range 0.01 to 100 g/liter, advantageously 0.1 to 10 g/liter. The corresponding proportion of the pyridine compound when used in combination is desirably 0.01 to 50, advantageously 0.1 to 5 g/liter.

The polyamine compounds and pyridine compounds described above can be mixed together to produce a liquid additive composition containing the compounds in the correct proportion to prepare and maintain a zinc plating bath according to the invention. A ready means is thus provided for the addition of the individual chemicals in the correct ratio not only as an initial addition but as mixtures of different proportions to replace these compounds as they are lost by chemical or electrochemical consumption or by physical losses resulting from "drag-out" of plating solution.

These mixtures can, in general, contain in aqueous solution, 20–600 g/liter of the linear polyamine and 10–200 g/liter of the pyridine compound. For example a liquid composition for addition to a zinc plating bath already containing the required inorganic compounds, in order to prepare a bath according to this invention, may contain 50–150 g/liter of linear polyamine and 25–75 g/liter of quaternised pyridine compound, while a liquid composition for maintaining a bath, may contain 20–50 g/liter of the linear polyamine and 10–30 g/liter of quaternised pyridine compound.

The following Examples illustrate the production of compounds useful in the process of this invention and their use in combination with a pyridine compound as defined.

EXAMPLE 1

10.2 g (0.1 mole) of dimethylaminopropylamine and 12.9 g (0.1 mole) 1,3-dichloropropan-2-ol were dissolved in 50 ml of water and refluxed for 2 hours. The resultant mixture was then diluted to make a 10% solution ready for testing.

EXAMPLE 2

20.4 g (0.2 mole) 3-dimethylamino-propylamine and 54.5 g (0 25 mole) 1,3-dibromopropan-2-ol were dissolved in 100 ml of methyl cellosolve in a 500 ml flask fitted with a reflux condenser. After 5 to 10 minutes the temperature began to climb and the mixture commenced refluxing. Reflux ceased after 20 minutes and the mixture was left for 2 hours and then diluted as in Example 1 to 10% strengh ready for testing.

EXAMPLE 3

7.2 g(0.05 mole) 3-diethylamino-butylamine and 7.0 g (0.05 mole) 1,3-dichloropropan-2-ol were dissolved in 100 ml of water in a round bottomed flask fitted with a reflux condenser. The mixture was refluxed for 2 hours and then diluted as in Example 1 to 10% strength ready for testing.

The following Examples illustrate the use of these reaction mixtures, in combination with the quaternised substituted pyridine compounds, in alkaline non-cyanide zinc plating solutions.

An alkaline non-cyanide zinc solution was made by using 2.5 g zinc oxide, and 97.5 g sodium hydroxide per liter, the heat of solution of the sodium hydroxide being used to dissolve the zinc oxide. The solution was then analysed and adjusted so that it contained 10.0 g per liter zinc ion and 100.0 g per liter hydroxyl ions.

Other concentrations of zinc ion and hydroxyl ion may be preferred in commercial practice and the above solution is only used to illustrate the action of the chemicals of this invention.

As a comparison, the following experiment was effected using no polyamine-containing reaction mixture. To 267 ml of the above solution in a standard Hull cell was added 1 0 g/l of the reaction mixture obtained from 1 mole of sodium nicotinate and 1 mole of benzyl chloride. A Hull cell panel was plated at 2 amps for 10 minutes, then half dipped in ½% nitric acid. The resultant zinc plate was not much better than that obtained from the alkaline noncyanide zinc solution alone, being only slightly more uniform and of a lighter colour. Addition of more of the reaction mixture did not produce a better plate.

EXAMPLE 4

To 267 ml of the alkaline non-cyanide zinc solution in a Hull cell was added 1.0 g/l of the diluted reaction mixture obtained in Example 2 and 0.8 g/l of the reaction product of sodium nicotinate and ethyl chloroacetate (1:1 molar ratio). A steel panel was plated at 2 amps for 10 minutes then half dipped in ½% nitric acid. The panel was very bright and uniform, the undipped area being almost indistinguishable from the dipped area.

EXAMPLE 5

To 267 ml of the alkaline non-cyanide zinc solution in a Hull cell was added 0.5 g/l of the diluted reaction mixture obtained in Example 3 and 0.5 g/l of the reaction mixture obtained from benzyl chloride and sodium nicotinate (1:1 ratio). A steel panel was plated for 10 minutes at 2 amps, then half dipped in ½% nitric acid. The panel was very bright and mirror like along its whole length. The undipped area could only just be discerned.

EXAMPLE 6

To an alkaline non-cyanide zinc solution was added 1 0 g/l of the diluted mixture of Example 1 and 1.0 g/l of a 20% solution of the reaction mixture obtained from benzyl chloride and sodium nicotinate and this solution was then used for electrodeposition of zinc on steel articles placed in bulk in a barrel. The small articles of total surface area 200dm$^2$ were placed in a cylindrical "Perspex" barrel with perforated sides immersed in this solution and placed between two zinc anodes. A current of 100A was passed between the articles in the barrel and the zinc anodes for 1 hour. At the end of this period, the barrel was unloaded and it was observed that the articles were electroplated with a very bright and almost mirror like zinc coating having a slight yellowish tint. The yellowish tint was removed by rinsing the zinc plated articles in clean running water and then dipping them in a so-called "blue" chromate passivating solution and rinsing them again. The articles became even brighter and were then tinted blue, giving an attractive finish after drying.

EXAMPLE 7

Liquid Additive Composition For Initial Make-Up Of Bath

An aqueous composition for addition to an alkaline, cyanide-free zinc platinb ath contains:

Linear polyamine of Example 1 — 100 g/liter.
Quaternised pyridine compound prepared from benzyl chloride and sodium nicotinate — 5P g/liter.

EXAMPLE 8

Liquid Additive Composition For Maintenance Purposes

In order to maintain the bath prepared by addition of the composition of the previous Example in optimum condition and replace the organic compounds in the proportion in which they are consumed, an aqueous additive can be made containing the following:

Linear polyamine of Example 1 — 35 g/liter.
Quaternised pyridine compound prepared from benzyl chloride and sodium nicotinate — 20 g/liter.

I claim:

1. In an aqueous alkaline, cyanide-free zinc electroplating bath containing zinc ions and hydroxyl ions, the improvement comprising said bath including an effective brightening amount of a. at least one linear polyamine obtained by condensing a diamine ot the formula

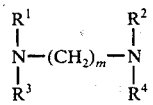

(I)

where $R^1$ and $R^3$, which may be the same or different, each represent an alkyl group with 1 to 4 carbon atoms, and $R^2$ and $R^4$, which may be the same or different, each represent a hydrogen atom or an alkyl group with 1 to 4 carbon atoms, and where *m* is an integer from 1 to 5, with a 1,3-dihalopropan-2-ol; together with b. at least one pyridine compound in the form of free base or as quaternised derivatives, in which the pyridine compound is a pyridine compound of Formula (IIa) or a pyridine compound having a cation of formula (IIb):

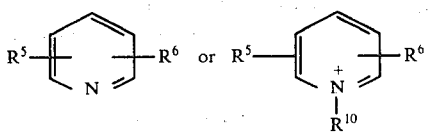

(IIa) (IIb)

where $R^5$ represents a hydrogen atom or an alkyl group with 1 to 5 carbon atoms; and $R^6$ represents a cyano group, a group —COOR$^7$ where $R^7$ represents a hydrogen atom, an alkali metal cation or an alkyl group with 1 to 5 carbon atoms; and $R^{10}$ represents a radical selected from the group consisting of aralkyl, alkyl, alkenyl, esterified carboxyalkyl and hydroxyalkyl groups.

2. A bath according to claim 1 in which the pyridine compound of formula II has $R^6$ in the 3-position.

3. A bath according to claim 1 in which the pyridine compound of formula (II) is selected from the group consisting of nicotinic acid, nicotinamide, N,N-diethylnicotinamide, 3-cyanopyridine, 4-cyanopyridine, methyl nicotinate, ethyl nicotinate, isonicotinic acid, 2-picolinic acid and butyl nicotinate and quaternised derivatives thereof.

4. A bath according to claim 3 in which the pyridine of formula (II) is quaternised by a radical selected from the group consisting of benzyl, ethoxycarbonylmethyl, propyl, allyl, ethyl, 2-hydroxyethyl, 2-ethoxycarbonylethyl, and 2-hydroxypropyl groups.

5. A bath according to claim 4 containing nicotinic acid or a salt thereof quaternised by a benzyl, ethoxycarbonylmethyl or allyl group.

6. A bath according to claim 1 in which the linear polyamine is the condensate of a diamine selected from the group consisting of 3-dimethylamino-propylamine, 3-diethylamino-propylamine, 4-diethylamino-butylamine, 2-diethylamino-ethylamine, 2-diethylamino-ethylamine, N,N,N'-trimethyl-ethylene diamine, N,N,N'-triethyl-ethylene diamine and N,N,N',N'-tetramethyl-1,2-diamino-ethane and 1,3-dichloropropan-2-ol or 1,3-dibromopropan-2-ol.

7. A bath according to claim 1 in which the linear polyamine is a condensate of a diamine and a 1,3-dihalopropan-2-ol in a molar ratio of from 2:1 to 1:2.

8. A bath according to claim 1 containing 0.01 to 100 g/liter of the linear polyamine and 0.01 to 50 g/liter of the pyridine compound.

9. A bath according to claim 8 containing 0.1 to 10 g/liter of the linear polyamine and 0.1 to 5 g/liter of the pyridine compound.

10. A brightener composition for addition to an alkaline, cyanide-free zinc electroplating bath, comprising a mixed solution of a. at least one linear polyamine obtained by condensing a diamine of the formula:

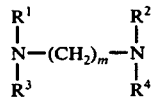

(I)

where $R^1$ and $R^3$, which may be the same or different, each represent an alkyl group with 1 to 4 carbon atoms, and $R^2$ and $R^4$, which may be the same or different, each represent a hydrogen atom or an alkyl group with 1 to 4 carbon atoms, and where *m* is an integer from 1 to 5, with a 1,3-dihalopropan-2-ol; and b. at least one pyridine compound in the form of a free base or as a quaternised derivative, in which the pyridine compound is a pyridine compound of formula (IIa) or a pyridine compound having a cation of formula (IIb):

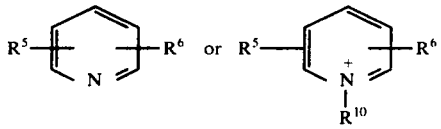

(IIa) (IIb)

where $R^5$ represents a hydrogen atom or an alkyl group with 1 to 5 carbon atoms; and $R^6$ represents a cyano group, a group —$COOR^7$ where $R^7$ represents a hydrogen atom, an alkali metal cation or an alkyl group with 1 to 5 carbon atoms; or a group —$CONR^8R^9$ where $R^8$ and $R^9$ which may be the same or different each represents a hydrogen atom or an alkyl group with 1 to 5 carbon atoms; and $R^{10}$ represents an aralkyl, alkyl, alkenyl, esterified carboxyalkyl or hydroxyalkyl group.

11. A composition according to claim 10 in which the pyridine compound of formula II has $R^6$ in the 3-position.

12. A composition according to claim 11 in which the pyridine compound of formula II is selected from nicotinic acid, nicotinamide, N,N-diethyl-nicotinamide, 3-cyanopyridine, 4-cyanopyridine, methyl nicotinate, ethyl nicotinate, isonicotinic acid, 2-picolinic acid and butyl nicotinate and quaternised derivatives thereof.

13. A composition according to claim 12 in which the pyridine compound of formula II is quaternised by a group selected from benzyl, ethoxycarbonylmethyl, propyl, allyl, ethyl, 2-hydroxyethyl, 2-ethoxycarbonylethyl, and 2-hydroxypropyl groups.

14. A composition according to claim 13 containing nicotinic acid or a salt thereof quaternised by a benzyl, ethoxycarbonylmethyl or allyl group.

15. A composition according to claim 10 in which the linear polyamine is the condensate of a diamine selected from 3-dimethylamino-propylamine, 3diethylamino-propylamine, 4-diethylamino-butylamine, 2-dimethylamino-ethylamine, 2-diethylamino-ethylamine, N,N,N'-trimethyl-ethylene diamine, N,N,N'-triethyl-ethylene diamine and N,N,N',N'-tetramethyl-1,2-diamino-ethane and 1,3-dichloropropan-2-ol or 1,3-dibromopropan-2-ol.

16. A composition according to claim 10 in which the linear polyamine is a condensate of a diamine and a 1,3-dihalopropan-2-ol in a molar ratio of from 2:1 to 1:2.

17. A composition according to claim 10 containing component (a) and component (b) in a ratio of from 2:1 to 1:2.

* * * * *

UNITED STATES PATENT OFFICE

CERTIFICATE OF CORRECTION

Patent No. 4,071,418 Dated January 31, 1978

Inventor(s) Barrie Sydney James

It is certified that error appears in the above-identified patent and that said Letters Patent are hereby corrected as shown below:

Column 3, Line 11, "U.S. Pat. Nos." should be -- Patent Specification No. --.

Column 4, Line 52, "strengh" should be -- strength -- ;

Column 7, Line 13, "2-diethylamino" should be -- 2-dimethylamino -- ;

Column 8, Line 38, "3diethylamino" should be 3-diethylamino -- .

Signed and Sealed this

*Twenty-second* Day of *May 1979*

[SEAL]

*Attest:*

RUTH C. MASON
*Attesting Officer*

DONALD W. BANNER
*Commissioner of Patents and Tradema*